US005665949A

United States Patent [19]

Fusco et al.

[11] Patent Number: 5,665,949

[45] Date of Patent: Sep. 9, 1997

[54] CATALYTIC CRACKING PROCESS FOR HYDROCARBONS

[75] Inventors: Jose Mozart Fusco, Niteroi; Jose Geraldo Furtado Ramos, Rio de Janeiro; Valmor Neves Vieira, Sao Mateus do Sul; Eduardo Cardoso de Melo Guerra, Petropolis, all of Brazil

[73] Assignee: Petroleo Brasileiro S.A. - Petrobras, Rio de Janeiro, Brazil

[21] Appl. No.: 507,558

[22] Filed: Jul. 26, 1995

Related U.S. Application Data

[62] Division of Ser. No. 305,399, Sep. 13, 1994, Pat. No. 5,569,435.

[30] Foreign Application Priority Data

Sep. 13, 1993 [BR] Brazil ..... 9303773

[51] Int. Cl.[6] ..... C10G 11/00

[52] U.S. Cl. ..... 208/161; 208/108; 208/113; 208/160; 208/168; 208/169; 208/150

[58] Field of Search ..... 205/161, 160, 205/164, 113, 108, 150

[56] References Cited

U.S. PATENT DOCUMENTS

| | | | |
|---|---|---|---|
| 4,455,220 | 6/1984 | Parker et al. | 208/161 |
| 4,478,708 | 10/1984 | Farnsworth | 208/161 |
| 4,502,947 | 3/1985 | Haddad et al. | 208/161 |
| 4,581,205 | 4/1986 | Schatz | 208/161 |
| 4,588,558 | 5/1986 | Kam et al. | 43/113 |
| 4,623,446 | 11/1986 | Haddad et al. | 208/161 |
| 4,666,586 | 5/1987 | Farnsworth | 208/161 |
| 4,961,863 | 10/1990 | Van Den Akker | 208/161 |
| 5,171,423 | 12/1992 | Kruse | 208/144 |

*Primary Examiner*—Helane Myers

*Attorney, Agent, or Firm*—Sughrue, Mion, Zinn, Macpeak & Seas

[57] ABSTRACT

A process for separating catalyst particles in the catalytic cracking of reacted hydrocarbons includes feeding the reacted hydrobarbons to an unconfined cyclone device made up of a diplegless cyclone opening directly into a large volume separator vessel downwardly through a mouth and upwardly through the annular space between concentric pipes. The concentric pipes are connected to the other components of the system as well as the hydrocarbon fluid catalytic cracking process carried out in the system.

6 Claims, 5 Drawing Sheets

CATALYTIC CRACKING PROCESS FOR HYDROCARBONS

This is a divisional of application Ser. No. 08/305,399 filed Sep. 13, 1994 now U.S. Pat. No. 5,569,435.

FIELD OF THE INVENTION

This invention is directed to a system to separate solids from gas and a process for the catalytic cracking of hydrocarbon feedstocks, whether high boiling point hydrocarbons are added or not.

More particularly the invention is directed to a system to separate particles from a catalyst suspension in catalytic cracking process from reacted hydrocarbon mixture. The system's novel and revolutionary idea enables the gas phase of particulated suspensions to be separated out more efficiently.

The invention has also to do with the operation of such system as well as with a new fluid catalytic cracking process (FCC) springing therefrom.

DESCRIPTION OF STATE OF THE ART

In the fluid catalytic cracking process (FFC) the purpose is to convert high boiling point hydrocarbons into light hydrocarbon fractions such as liquified petroleum gas.

The catalyst used in FCC is a very fine powder, particles of which act like a liquid when fluidized in steam or air.

The fluidized FCC catalyst circulates continuously between the reaction and regeneration zones. In the first of these, together with the cracking reactions, a carbonaceous deposit (coke) is created on the surface of the catalyst, reducing the activity and selectivity of the catalyst. Removal of such deposit takes place in the second zone, by its being burnt in air, the activity and selectivity of the catalyst becoming high again. The catalyst also acts as a medium for the transfer of heat from the regenerating to the reacting zone.

Upon introduction of catalytic cracking catalysts containing zeolites, particularly the ultra stable zeolites, together with the use of high reaction temperatures and cracking with short residence time in riser reactor, fresh areas were found in which to develop the technique, so as to enable advantage to be taken of the high activity and selectivity of such zeolitic catalysts.

The usual technique consists of feeding the catalyst mixture, as a warm suspension, together with the sprayed hydrocarbon droplets into a riser where cracking reactions take place. Residence time for the reacting mixture is from 0.5 to 8 seconds in reaction temperatures of over 485 degress Celsius.

As mentioned, along with such cracking reactions, a harmful carbonaceous deposit (coke) develops on the surface of the catalyst which leads to a drop in activity and selectivity.

After the riser it is particularly advisable that coked catalyst particles be swiftly separated from the cracked hydrocarbon suspension, in order to avoid any lengthy contact of gas and particle phases, which would lead to the development of side reactions, known as overcracking.

Such undesirable overcracking reactions which convert noble products, as for instance, gasoline, into fractions of heating gas, coke and liquified petroleum gas (LPG), are basically brought on by heat and take place due to lengthy contact time between the gas phase of reacted mixture and particulate solid phase of the catalyst, or merely because of an overlengthy permanence of gas phase of reacted mixture at a high temperature in the separation zone.

In the usual technique the suspension of catalyst and cracked hydrocarbons from the riser is fed into the separating vessel, generally as a descending jet, where most of the catalyst is separated by gravity. Cracked hydrocarbons in stripping fluid entraining some of the catalyst flow into the upper part of the separating vessel, where cyclone separators bring about the particulate phase separation, and then finally the gas phase go on to the product fractioning system. The catalyst separated in the cyclone drops into the dipleg of the cyclone, becoming a dense column of solids that flows into the stripper, after pressure between base of cyclone dipleg and outside environment has been equalled. Under this well known operation the pressure inside the cyclone is always less than in the pressure vessel, cyclone dipleg having to be sealed off, whether by submerging it in the fluidized catalyst bed of the stripper or by use of some kind of sealing valve placed at its bottom end.

In the lower part of the separating vessel a fluidized bed of spent catalyst develops, which is stripped with the aid of a stripping fluid.

This stripping process brings about the removal of the reacted gas phase which takes up inter- and intraparticle spaces, and also of some adsorbed heavy hydrocarbons, thereby preventing same from being carried to the regenerator thereby avoiding the unnecessary burning thereof, which would lead to a large rise in the temperature of the regenerator.

In this usual way of carrying out the FCC process, dimensions of separating vessel are large in order to provide for riser end, disengagement room for solids cyclone separators and their respective diplegs, leading to a large volume and therefore overlengthy residence time of reacted gas phase inside such vessel, plus the aforesaid harmful effects brought about thereby. On the other hand so large a space is also an advantage; for example: those engaged in such work know only too well that risers do not operate in a uniform fashion; there may be a sudden rise in pressure, in catalyst mass- and volume flow rarer by as many as two to twenty times, brought about by changes in the operation of the unit such as, for instance the entrainment of an air pocket together with the hydrocarbon feed, which variations are easily taken up by the great amount of room within the separator vessel without leading to any undesirable consequences such as entrainment of the catalyst into the fractioning system.

In order to minimize reaction caused by any overcarcking after the riser, brought about by the long time in contact with reacted gas and particulate solid stages, or merely due to stay of said reacted gas phase within the separator vessel various methods and procedures have already been suggested.

One of the most efficient among them is the system commonly known as the "closed cyclone" system which is based on the notion of the riser being directly linked to the cyclone separator.

Along such lines there are many alternatives in the present state of the art:

Larry W. Kruse, U.S. Pat. No. 5,171,423, describes a large size outside cyclone separator provided with a lower chamber fitted with baffles and a device for the injecting of stripping fluid which in turn feeds the reacted gas-phase suspension with some particulates for a separator vessel, where cyclones bring about the final separation, in the usual way, of the solid that has been entrained. The solid collected in the separator vessel flows into the cyclone separator by means of a pipeline for such purpose. Such outside cyclone separator is meant to cut down on part of the charge of solids to be led into the separator vessel, and at the same time begin the stripping process. The inventor says that this arrangement is particularly useful towards minimizing the effects of any discontinuos operation of the riser. In he preferred arrangement for the invention to be reduced to practice, the reacted gas stream that feeds the separator vessel is quenched by a cold stream of hydrocarbons in order to reduce temperature and minimize the effect of any overcracking.

Wesley A. Parker et al, U.S. Pat. No. 4,455,220, describe a cyclone separator internally provided with s vortex stabilizer and a lower chamber for injecting the stripping fluid. In this device the catalyst, hydrocarbons and stripping fluid pass completely through the inside of the cyclone. The vortex breaking and ending device is meant to diminish the effects of the dragging of collected particles caused by entry of stripping fluid in bottom part of the cyclone.

T. Gauthier, EP 0545771, describes equipment much like that referred to above. The difference lies in the cyclone separator gas outlet which goes downwards, enabling both feed and discharge gases to flow concurrently.

Schatz U.S. Pat. No. 4,581,205, describes application of a small vessel between the cyclone and riser meant to accommodate pressure and flow surges arising out of any unsteady operation of riser. This smaller vessel which fits into the separator vessel is fitted with fluid injection to strip the catalyst in its bottom part. Side windows in the pipes connecting it to the riser, and in those of the smaller vessel itself and of the cyclone enable any sudden expansion of gases to be dealt with. The top part of these windows is hinged so as to enable them to open and relieve the pressure. The stream of hydrocarbons and stripping fluid together with some of the catalyst flow from the smaller vessel into the cyclones. The separated catalyst flows along the diplegs of the cyclone which are fitted with check valves and the gases flow into the fractioning system, Haddad et al, U.S. Pat. No. 4,502,947 provides a cyclone separator directly connected to the riser and to the first and second stage cyclones. Concentric pipes connect riser cyclone gas outlet with mouth of first stage cyclone inlet. Stripping steam flows in annular space between the concentric pipes, together with some entrained catalyst. In this preferred configuration a pot of wider diameter than that of the riser cyclone leg and lying in the bottom end thereof allows cyclone to be sealed off and enables catalyst gathered therein to overflow from it. Upon assembly and lining up of the concentric pipes it is suggested that different kinds of fillers be put inside the annular space though leaving some room for the stripping steam to flow within it.

Another arrangement of this appliance, referred to in U.S. Pat. No. 4,623,446, does away with the sealing pot in the riser cyclone leg, thereby enabling stripping steam to flow through it, there being no need for the concentric pipes connecting riser cyclone to first stage cyclones. Size of the riser cyclone leg dimensioned for operation at a speed of 0.03 to 0.30 meters per second, this being enough to minimize any catalyst entrainment into the cyclone, thus preventing any efficiency loss.

Kam et al, U.S. Pat. No. 4,588,558, provide an alternative way of dealing with any sudden rise in pressure, by installing hinged windows in the pipe that connects riser to riser cyclone and in the inter connecting pipe to the cyclone first stage. Cyclone diplegs are fitted with hinged type check valves. Windows in the riser upstream of the cyclone connection provide a path for the stripping steam to flow from the separating vessel into the separation system.

Van Den Akker et al, U.S. Pat. No. 4,961,863, provide an alternative arrangement between cyclone and riser in such a way that the axes of such equipment lie at right-angles to one another. The curved surface of the cyclone thus lies at a tangent to the open upper end of the riser. The device is provided with a dipleg sealed off to the flow of any solids and with at least one pipe lying on the same axis as the cyclone, for the gas phase to flow. Stripping steam is injected into the cyclone, into the upper end of the dipleg that drains the particulate phase.

Though progress has been made towards minimizing overcracking reactions in FCC processes, nevertheless in all the 'closed cyclone' system alternatives referred to above only cyclone separator devices featuring the confinement of the separated solid phase are provided in the riser outlet cyclone separating stage.

In some instances the cyclone separators are provided with a dipleg to take the enclosed flow of the large mass of solids gathered, and likewise means for sealing off the bottom part of said leg so as to avoid any efficiency loss of the riser cyclone caused by the flow of stripping fluid within it and consequent reentrainment of catalyst particles.

In other instances the cyclone is the very vessel which encloses the stripping chamber, within which both separating and stripping take place, with the known collecting efficiency loss taking place in the cyclone separator.

Use of enclosing cyclone separators makes it difficult to deal with any unsteady operation of riser which leads to a drop in efficiency of separator and therefore to undesirable overcracking reactions due to entrainment of the gas phase which reacted with the catalyst suspension, as well as heavy catalyst losses to the product fractioning system and auxiliary equipment thereof.

In trying to overcome this drawback Farnsworth, U.S. Pat No. 4,478,708, provides a method where the outflow of particles in suspension from a riser is separated by means of a cylindrical zone opened up in it bottom part, upper part of which is connected peripherally to the riser by means of an enclosed radial path and tangentially connected to said cylindrical zone, which is closed at its upper end except for a small diameter coaxial pipe along which the gas is withdrawn. Solids are discharged from the open part of the cylindrical zone. Separation takes place by centrifugal action; the enclosed feed paths for the cylindrical zone may be curved horizontally in order to get centrifugal separation started.

Farnsworth again, U.S. Pat. No. 4,666,586, provides another method, like the first one, whereby separation takes lace in one single zone shaped like an inverted cup, The major difference between these methods and those described before lies in the cyclone separating device directly connected to the riser which is devise in such a way that there is no further need to confine the solids collected by means of a dipleg, that is, the cyclone is a non-confining cyclone, not provided with a dipleg, its bottom half open directly to the separator vessel, thereby taking advantage of the large volume of the latter so as to take up any operation discontinuity of the riser.

Although helping deal with he problem of controlling any unsteady operation of the riser met with in the common closed cyclone systems, the non-confining cyclones devised by Farnsworth are seriously handicapped by the-fact that all of the stripping gas must pass through them, upwards and against the particulate flow, a fact which may lead to such particles being reentrained and consequently reducing efficiency.

SUMMARY OF THE INVENTION

A new system of separation is herewith provided, specifically meant for use in FCC processes, even in those already in use, and which consists of an original and novel and low-cost idea suitable for such systems.

The chief novelty of the system is that the cyclone-separating device is directly connected to the riser which comprises a cyclone with no dipleg that opens directly into the separator vessel, simultaneously in both lower and upper parts, thereby achieving separation that is pretty efficient and keeping up gains derived from rapid separation of reacted gas phase from the suspension of catalyst particles with its reduced activity and selectivity, as well as those due to dealing with the unsteady operation of the riser.

A new FCC process is described herein as well, being brought about by use of such separator system, which is outstandingly better technically speaking, above all as regards the control over process variables.

DESCRIPTION OF INVENTION

Figure 1:
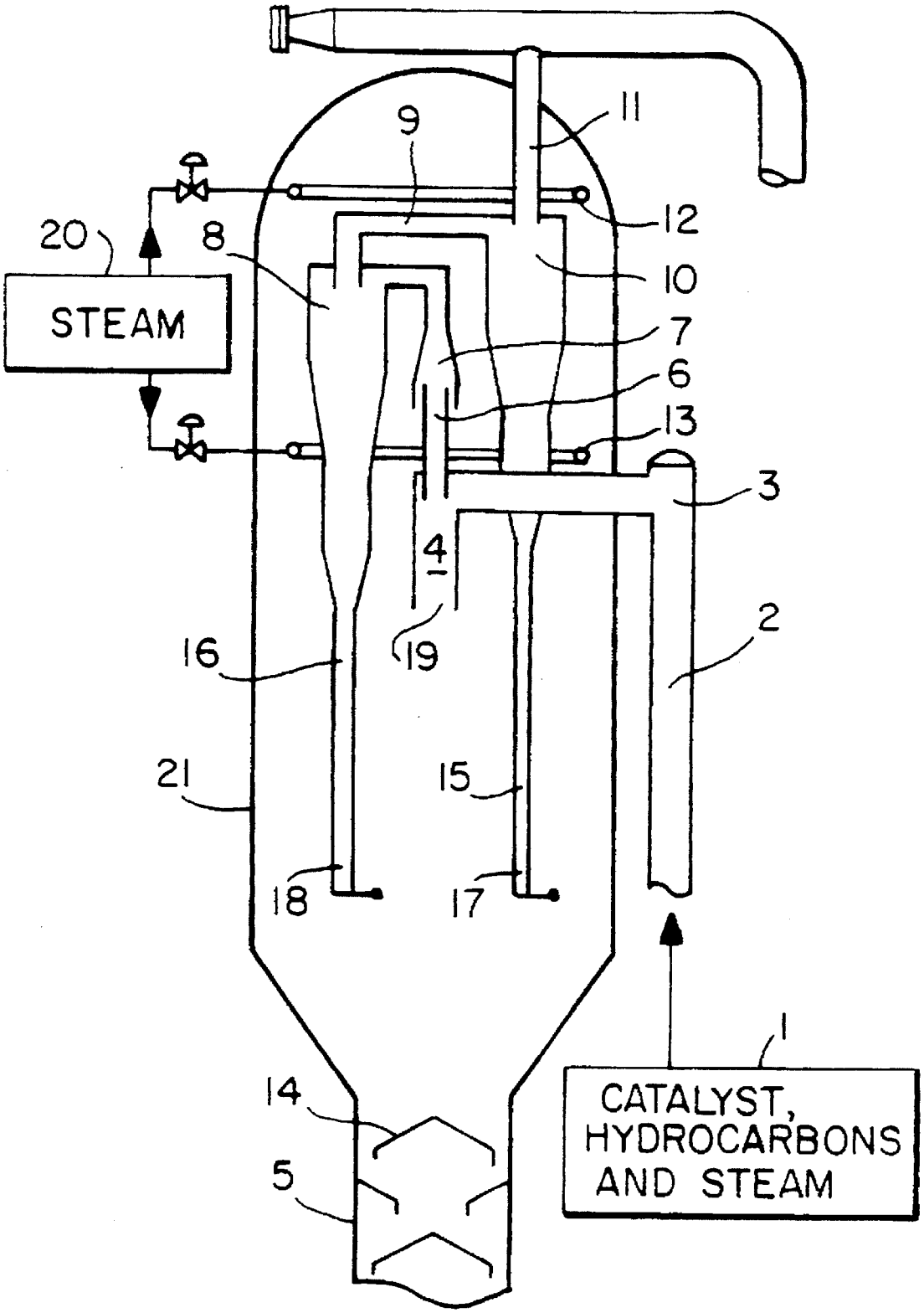
FIG. 1 is a schematic side view of the separator vessel employed in the fluid catalytic cracking process according to a first embodiment.

FIG. 1 serves to show that the system herewith invented consists of a device made up of a diplegless cyclone (4) directly connected to a riser (2) and, by means of concentric pipes (6,7), also directly connected to a primary cyclone (8). The cyclone 4 is associated with a fluid catalytic cracking process (FCC) for hydrocarbons, with highboiling hydrocarbons which may be added or not. The process comprises closely mixing a sprayed charge of hydrocarbons, in droplets, together with a suspension of catalyst particles heated in a catalytic cracking zone (1), carrying on with cracking of aforesaid charge in the riser (2), feeding a considerably rich suspension of catalyst particles and cracked hydrocarbons directly into the separating device by means of a rectangular cross-section pipe (3) directly connected to the riser (2), bringing about the swift separation of gas from particulate phases inside the diplegless cyclone (4), feeding, with the help of concentric pipes (6,7), the gas stream containing some catalyst for later separation into primary cyclone (8) and then, by means of connection (9) into secondary cyclone (10), from the stream of gas substantailly free from catalyst particles into the fractioning system, along outlet pipe (11) of separator vessel (21).

All of the catalyst separated out by cyclones (4,8,10) is gathered in a small diameter vessel (5) having baffles 14 which lies in the bottom part of separator vessel (21) from where it flows into the regeneration zone (not shown).

In said vessel the hydrocarbon gas phase is taken away by inter- and intraparticle stripping and part of some heavier hydrocarbons are adsorbed, by countercurrently injecting stripping fluid to the descending stream of catalyst. In a preferred mode all of the stripping fluid together with the stripped matter joins the stream of cracked hydrocarbons which circulates in the diplegless cyclone (4) through mouth (19).

The catalyst separated out in both primary (8) and secondary (10) cyclones, gathered in legs (15,16), becomes a column of solids which after having reached the pressure needed for equilibrium within the system, flows out through check valves (17,18).

Purging of stagnated parts of the separator vessel (21) is done by purge fluid from a steam supply 20 through injecting devices (12,13). The most suitable way is to run part of such purge fluid into the annular space between concentric pipes (6,7) and the other part together with the stripping fluid countercurrent to the solids which flow out of mouth (19) of the diplegless cyclone (4).

In this invention the material flowing from inside of the separator vessel (21) to the inside of cyclone (4)through mouth (19) consists of 0.1 to 20% of the total volume that flows along outlet pipe (11). The remaining material flows from inside the separator vessel by means of the annular space between the concentric pipes (6,7).

An alternative to reduce this invention to practice is, whenever it is wished, to bleed a suspension of particles and reacted mixture through the lower mouth (19) of the diplegless cyclone (4). This helps a lot towards achieving greater efficiency in the gathering of solids within the separating device invented. In blocking the gas stream from separator vessel (21) to within cyclone (4) an reentrainment of catalyst particles is prevented, this being the great problem in dealing with unconfined cyclones. Hydrocarbons bled off, representing from 3 to 20% of outflow to the fractioning system come from separator vessel (21) together with the stripping fluid, the purging fluid and catalyst particles, out of the upper part of the diplegless cyclone (4) or through the annular space between the concentric pipes (6,7).

Figure 2:
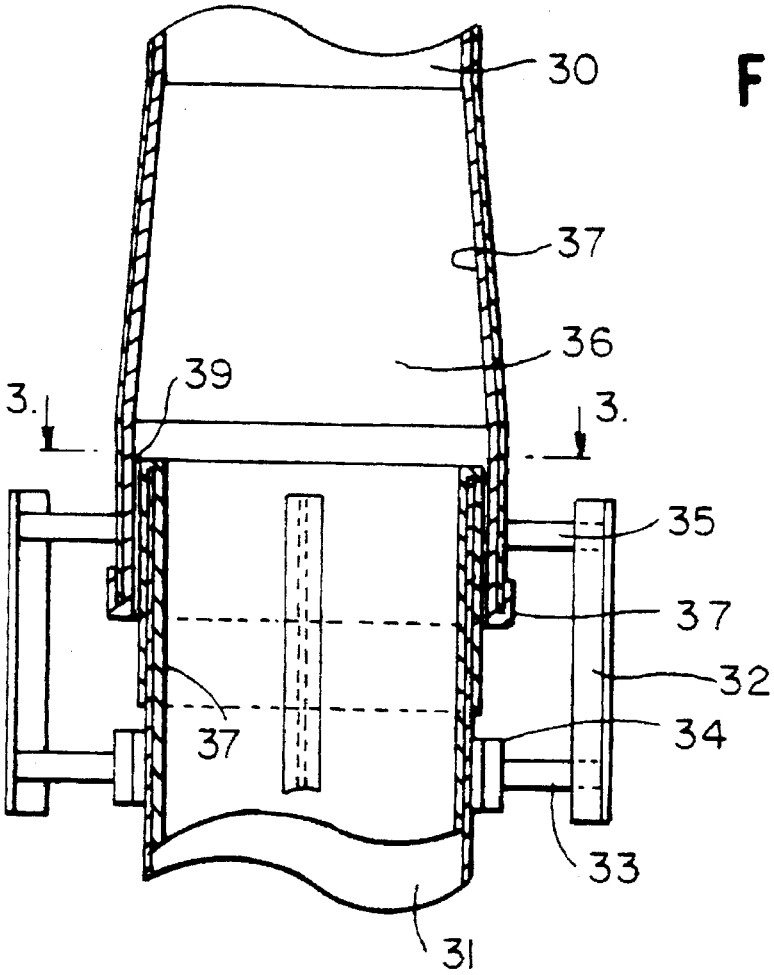
FIG. 2 is a detailed longitudinal sectional view of a concentric pipe assembly according to a first embodiment.
Figure 3:
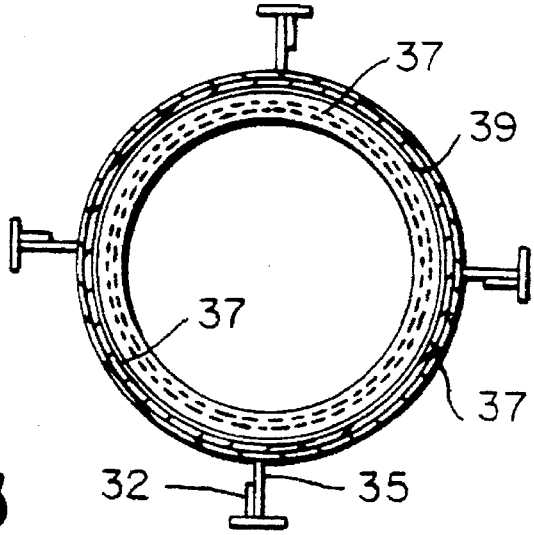
FIG. 3 is a sectional view taken along the line 3—3 in FIG. 2.

FIG. 2 shows a first embodiment of a concentric pipe assembly wherein the pipe 30 is provided with a conical section 36 at the lower end thereof which is concentrically disposed in spaced relation to the upper end of a lower pipe 31. The conical section 36 is supported by lateral brackets 35 connected to a vertical support 32 and the bottom pipe 31 is supported by a bracket assembly 33, 34 connected to the vertical support 32. An annular space 39 is provided between the concentric pipes. The pipes 30 and 31, as well as the conical section 36 are provided with a liner 37 which extends over the ends of the pipeS 30 and the conical section 36.

Figure 4:
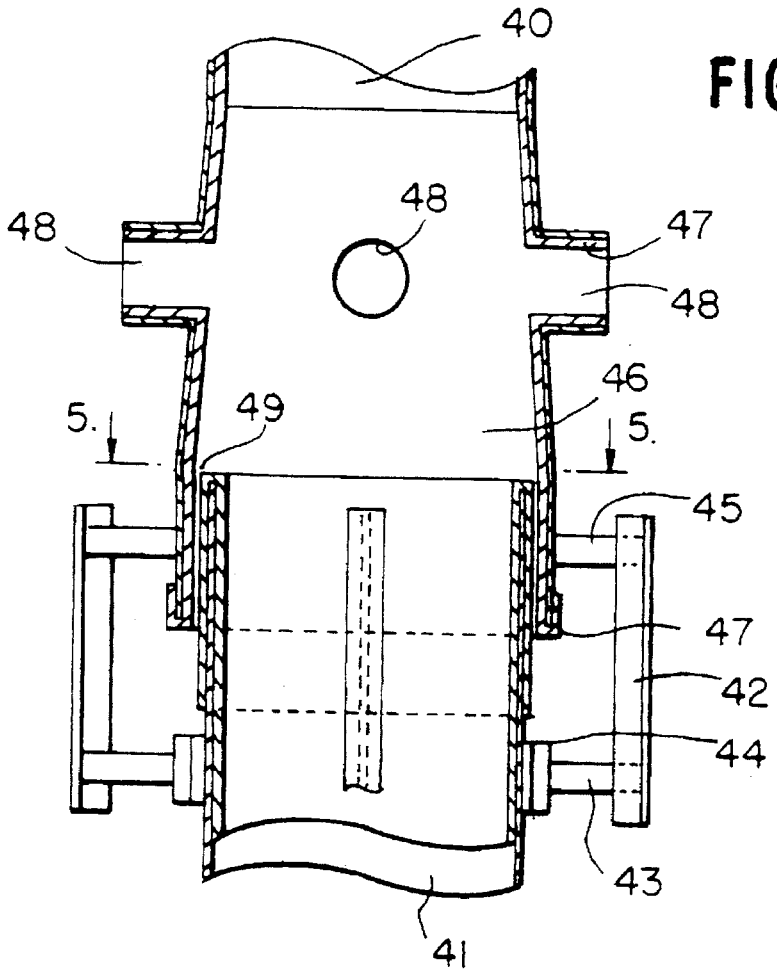
FIG. 4 is a detailed longitudinal sectional view of a concentric pipe assembly according to a second embodiment.
Figure 5:
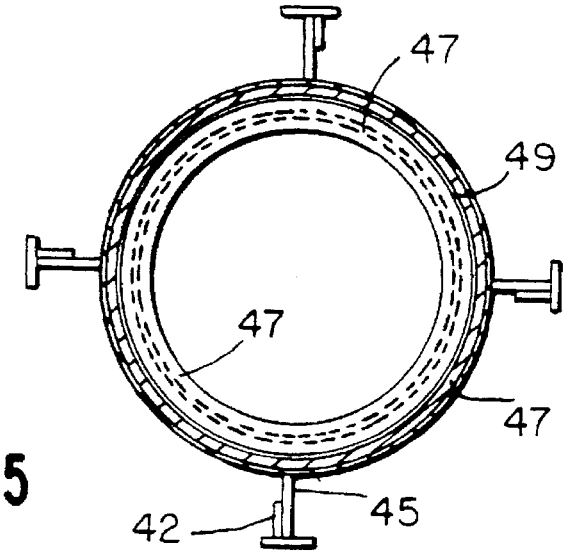
FIG. 5 is a sectional view taken along the line 5—5 in FIG.

A second embodiment of the conical pipe arrangement is shown in FIGS. 4 and 5, wherein the upper pipe 40 is provided with a conical section 46 disposed in concentric spaced relation to the upper end of the lower pipe 41 to provide an annular passage 49 therebetween. The conical section 46 is supported by means of lateral brackets 45 connected to vertical supports 42 and the lower pipe 41 is supported by bracket assemblies 43, 44 connected to the vertical supports 42. In order to help bleed fluid from the inside of the separator vessel 21 to the inlet of the first stage cyclone, a plurality of laterally extending pipes 47 are provided on the conical section 46 to provide open windows 48. The pipes 40 and 41, as well as the conical section 46, are provided with a liner 47 which extends over the ends of the pipes 40 and 41.

This second operating alternative of the invention comes into play whenever flow of fluid injected through the purge fluid injecting devices (12,13) is small.

This serves to show the biggest advantage of the process now invented: flexibility of outlet control over purge and stripping fluids and some cracked hydrocarbon vapor that flows out from inside the separator vessel (21). This control can be done with the aid of solids discharge mouth (19) of diplegless cyclone (4), or from the annular space between the concentric pipes (6,7) of said cyclone, with the unit in operation.

Figure 6:
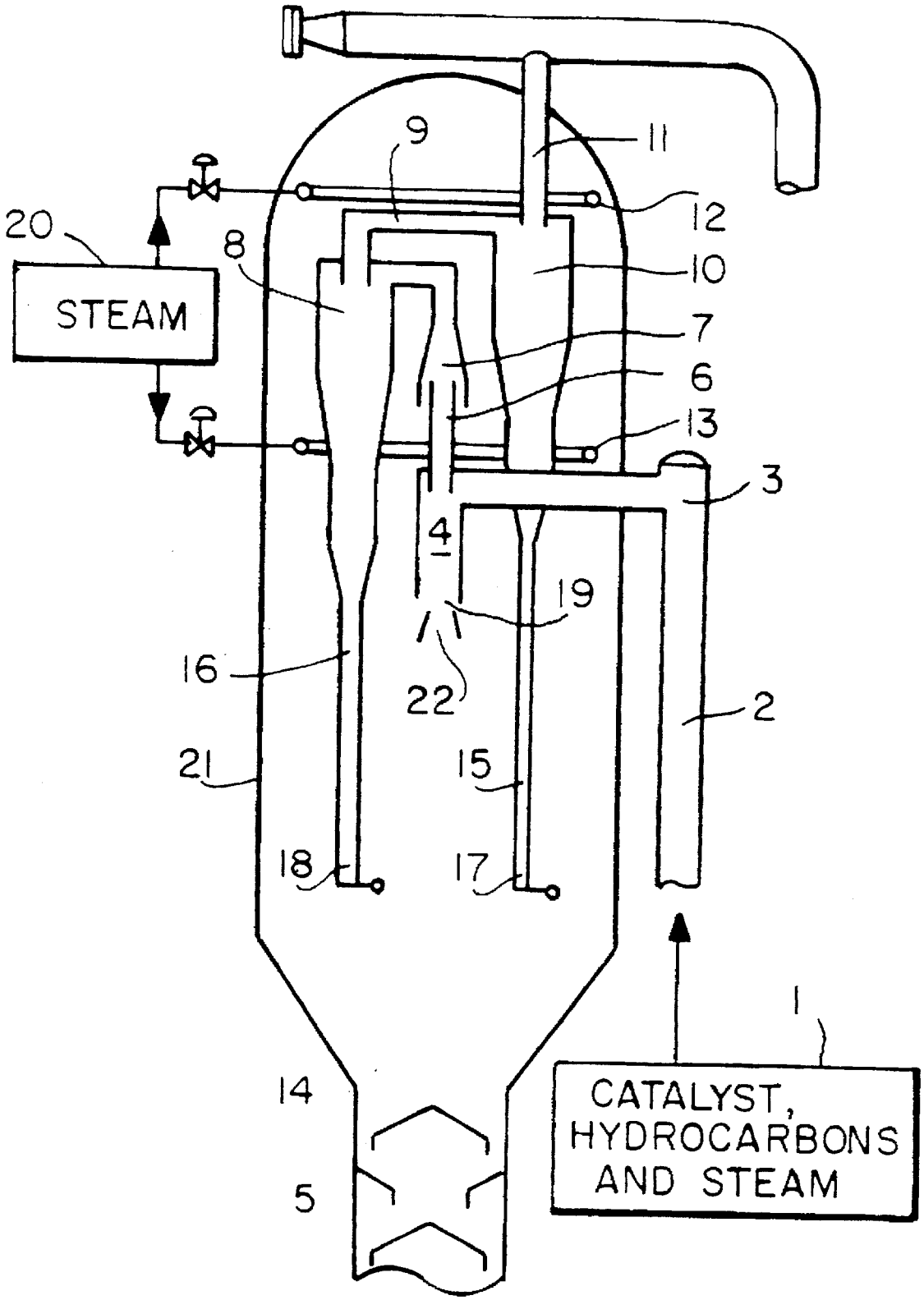
FIG. 6 is a schematic side view similar to FIG. 1 showing a separator vessel assembly according to a second embodiment.
Figure 7:
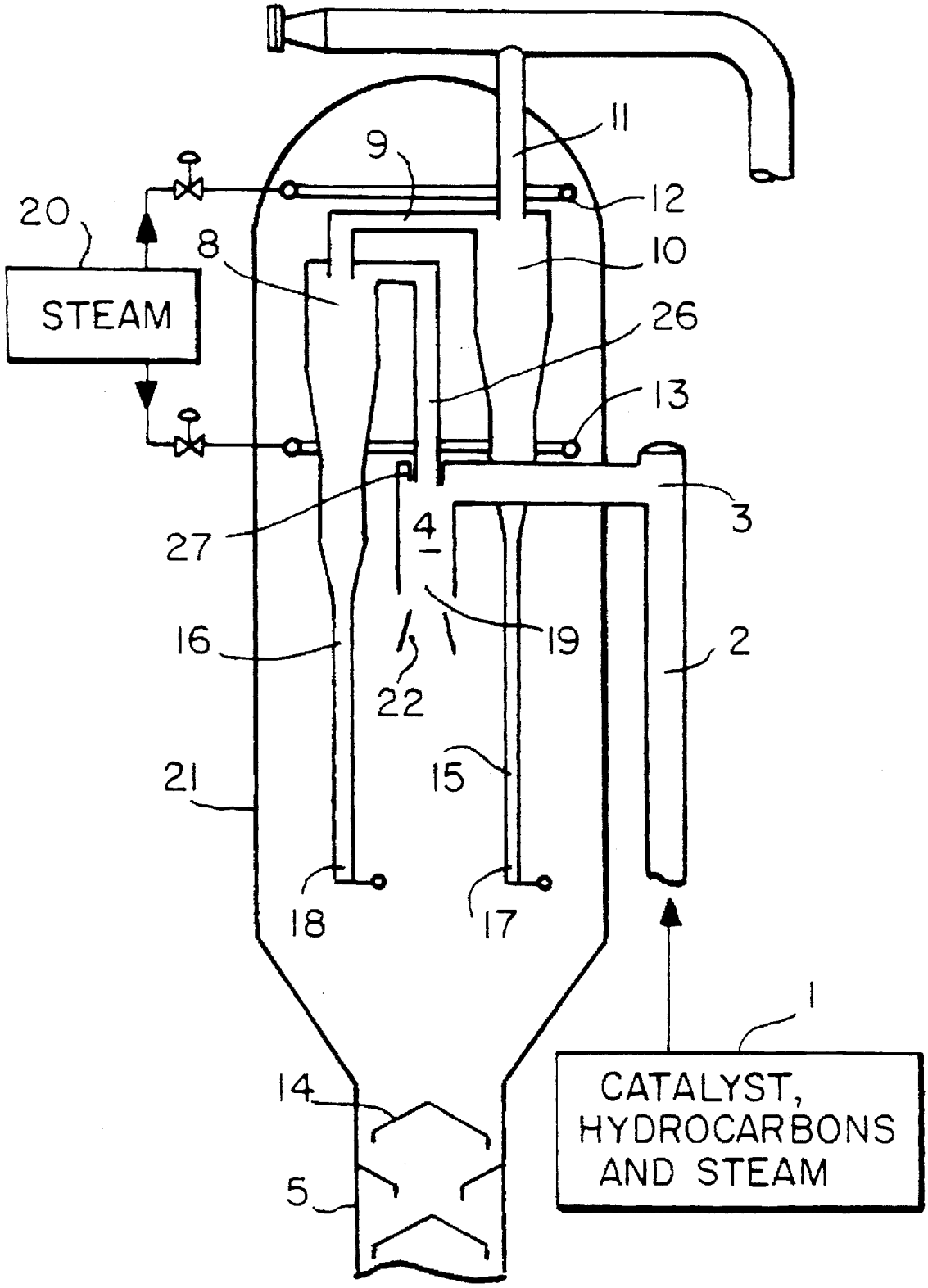
FIG. 7 is a schematic side view similar to FIG. 1 showing a third embodiment of the separator vessel assembly.

Two examples of suitable arrangements, out of the many for this invention, are shown in drawings under FIGS. 6 and 7, namely: the providing of a distributor (22) for the downward flow of particles separated in the diplegless cyclone (4); and a design of the same kind of cyclone provided with concentric pipes (26,27) connecting it to primary cyclone (8).

From the foregoing, other easily perceived advantages of the invention are, e.g.:

a) since there is no leg to the cyclone connected directly to the riser, most of the catalyst particles separated out from the reaction stream flow out directly through its lower open mouth and fall in a smooth and diluted fashion into an environment saturated with purge and stripping fluids, down to the bottom of the separator vessel. Along this stretch a great amount of stripping of the catalyst is already taking place because the intra-particle transfer of mass is much favoured which fact greatly reduces the need of stripping in the dense phase, as happens in the usual way of operating, and even does away with the need to inject fluid specifically for such purpose, thereby considerably simplifying the design and operation of such processes.

b) ease of changing from one operating mode to another, with a comeback to near the usual conditions in the traditional process, merely by regulating flow rates of purge fluid, so as to raise yields of gases and LPG, some of the hydrocarbons of which can be used as petrochemical feedstocks, which operating mode can be economically attractive according to the season.

c) the fact that it is easy to introduce the system now invented into existing units with only minimum modifications to any equipment already installed, the only thing needed being that the size of the system be in keeping with capacity of the unit in which it is to be employed.

We claim:

1. A catalytic cracking process for hydrocarbons comprising the following steps:

(a) mixing a hydrocarbon feed stock with a suspension of catalyst particles in a catalytic cracking zone;

(b) cracking said feed stock in a riser;

(c) feeding the reacted suspension into a cyclone separator system to bring about separation of the gas phase from the particle phase, a gas stream being led into the fractioning system through an outlet pipe;

(d) collecting the particle phase in a smaller diameter vessel lying in a bottom part of a separator vessel for directing the particle phase into a regenerating zone;

(e) purging stagnated parts of said separator vessel by injecting a purge fluid through purge fluid injecting devices; and (f) stripping catalysts in said separator vessel;

wherein said feeding step (c) of the reacted suspension takes place directly from the riser to an unconfined cyclonic device comprising a diplegless cyclone having an open lower mouth and an upper annular space between concentric pipes which opens into said separator vessel and wherein in said purging step (e) the purge flow through purge fluid injecting devices is adjusted so that all of the purged material, together with the stripping fluid, flows from within the separator vessel through the annular space between the concentric pipes.

2. A process as set forth in claim 1, wherein the purge flow through purge fluid injecting devices is adjusted so that most of the purged material flows from within the separator vessel through the annular space between concentric pipes while all of the stripping fluid and a smaller part of the purge fluid injected, together with the stripped gas, flow countercurrently to the stream of solids through the lower mouth of the cyclone.

3. A process as set forth in claim 2, wherein the discharged gas which flows into the lower mouth of the cyclone comprises 0.1 to 20% in volume of all the material that flows along the outlet pipe.

4. A process as set forth in claim 1, wherein part of the purge stage (e) may be brought about by bleeding off the particle suspension and the reacted mixture through the lower mouth of the cyclone which afterwards, flows together with the stripping fluid and some of the purging fluid through the annular space between the concentric pipes and small windows in a conical stretch which houses said pipes.

5. A process as set forth in claim 4, wherein said bled material accounts for 3 to 20% of volume of discharge into the fractioning system along said outlet pipe.

6. A process as set forth in claim 1, wherein said stripping step (f) is carried out by countercurrently injecting stripping fluid in the catalyst downward stream.

* * * * *